United States Patent [19]

Hand

[11] 4,406,605

[45] Sep. 27, 1983

[54] APPARATUS FOR FORMING CONCRETE PIPE OF UNIFORM DENSITY INCLUDING CONTROL MEANS TO VARY FEED RATE OF CONCRETE/AGGREGATE AS FUNCTION OF PACKERHEAD TORQUE

[75] Inventor: George E. Hand, Williamstown, N.J.

[73] Assignee: Kerr Concrete Pipe Company, Folsom, N.J.

[21] Appl. No.: 188,032

[22] Filed: Sep. 17, 1980

Related U.S. Application Data

[63] Continuation-in-part of Ser. No. 39,316, May 16, 1979, Pat. No. 4,336,013.

[51] Int. Cl.[3] ..... B28B 3/18; B28B 21/24

[52] U.S. Cl. ..... 425/145; 318/39; 318/77; 364/469; 364/511; 425/150; 425/262; 425/427; 425/449; 425/457

[58] Field of Search ..... 364/469, 475, 511, 476, 364/492; 318/77, 98, 11, 39, 80, 317; 264/40.1, 40.4, 40.7, 309, 310, 312, 267; 425/60, 117, 135, 145, 146, 150, 218, 254, 260, 460, 418, 419, 426, 427, 429, 262, 260, 449; 78/571

[56] References Cited

U.S. PATENT DOCUMENTS

| | | | |
|---|---|---|---|
| 2,758,352 | 8/1956 | Perkins | 425/262 |
| 3,125,714 | 3/1964 | Eisengren | 318/11 |
| 3,325,710 | 6/1967 | Reynolds | 318/39 |
| 3,660,003 | 5/1972 | Waddington | 425/427 |
| 3,662,437 | 5/1972 | Long | 425/262 |
| 3,746,494 | 7/1973 | Gauger | 425/262 |
| 3,855,511 | 12/1974 | Smith | 318/317 |
| 3,942,114 | 3/1976 | Keeling | 318/317 |
| 3,991,984 | 11/1976 | Porter | 364/511 |
| 4,237,408 | 12/1980 | Frecka | 364/475 |
| 4,249,113 | 2/1981 | Werner | 318/39 |

*Primary Examiner*—Willard E. Hoag

*Attorney, Agent, or Firm*—Ronald G. Goebel

[57] ABSTRACT

In order to form concrete pipe of uniform density in apparatus where a packer head packs concrete into a mold to form the pipe, the horsepower of the drive motor driving the packer is sensed and used to adjust the rate of concrete supply such as to insure a constant horsepower as the packer is moved from one end of the pipe mold to the other.

24 Claims, 18 Drawing Figures

APPARATUS FOR FORMING CONCRETE PIPE OF UNIFORM DENSITY INCLUDING CONTROL MEANS TO VARY FEED RATE OF CONCRETE/AGGREGATE AS FUNCTION OF PACKERHEAD TORQUE

This application is a Continuation-In-Part of copending application Ser. No. 039,316, filed May 16, 1979 now U.S. Pat. No. 4,336,013.

BACKGROUND OF THE INVENTION

This invention relates to the formation of concrete pipe of uniform density and compaction.

In the packer head method of forming concrete pipe, concrete mix is fed by means of a motor powered conveyor to a cylindrical mold located beneath the conveyor containing a rotating packer head for packing concrete against the inner wall of the mold. The packer head contains a plurality of peripheral rollers which act to compress the added concrete mix against the mold inner wall. The packer head is rotated by an electric motor coupled to a shaft centrally mounted on the packer head. A lifting device is also coupled to the shaft and motor to raise and lower the packer head within the mold.

The concrete pipe is formed by rotating and raising the packer head through the mold while concrete is fed by the conveyor to the mold. Reinforced concrete pipe containing a wire cage as well as unreinforced pipe can be made by this method.

Usually this is done in two stages called passes, each pass consisting of the raising of the packer head upwardly through the mold while concrete is fed thereto. The first pass serves to roughly form the pipe and the second pass performs a finishing operation on the inside surface of the roughly formed pipe by smoothing out internal surfaces and evening out the pipe inner diameter along its entire length. Control is carried out manually by an operator. Pipe made by this method is generally non-uniform in density and compaction. Such non-uniform density is a result of inefficient operator control of the apparatus. In the operation the operator visually assesses the uniformity of density of concrete and manually adjusts the rate of feeding concrete from the conveyor into the area of formation between the packing head and the mold as the article is being formed. Such operator-controlled procedures are highly inefficient and ineffective.

Non-uniform density of concrete in areas of formation as the article is being formed in such devices resulting from inefficiency of such operator-controlled procedures generates formation of stresses in the article. In the case of forming non-reinforced concrete articles by this method, such stresses generate cracks which substantially weaken the formed pipe resulting in damage and leakage during use. In the case of reinforced concrete pipe, such stresses generate bending and deflection of the reinforcing wire cage forming voids which also substantially weakens the pipe, resulting in damage and leakage during use.

In U.S. Pat. No. 3,746,494 to F. Gauger, a method for forming concrete pipe or tubes of uniform compaction is provided employing a packer head apparatus wherein the torque supplied by the packer head motor to the mold during pipe formation and which varies with the rate of supply of concrete is detected, the degree of compaction of the concrete being a function of the torque supplied by the motor, the rate of rise of the packer head is decreased when there is detected a decrease in the amount of torque and increased when there is detected an increase in torque. This uniform compaction and density of concrete pipe is formed according to this patent by varying the rate of packer head rise while the rate of concrete feed to the mold is held essentially constant.

The apparatus also includes a driven impeller mounted atop the packer head which is driven at a greater rotational speed than the rotational speed of the packer head and in a direction opposite to that of the packer head. The packer head is lifted by a hydraulic ram connected with the packer head shaft and connected by a pressure oil supply pump by means of a duct which is connected with a valve. This valve is responsive to the supply pressure of a hydraulic motor and connects the ram to a greater or lesser extent with an oil container as the pressure in the hydraulic motor supply duct varies.

The present invention, on the other hand, provides a method and apparatus for producing concrete pipe of uniform density by the packer head operation and compaction which employs a variable concrete feed rate but a constant rate of rise of the packer head as well as a constant packer head motor speed. The invention includes an automated system which measures horsepower of the packer head motor and through a feedback signal to the conveyor motor maintains a feed rate which will result in a constant horsepower and thus produce uniform density pipe. The apparatus of the invention may be computerized to coordinate all mechanical functions.

SUMMARY OF THE INVENTION

According to the present invention, concrete pipe of uniform density is produced, particularly in a two pass operation, by maintaining the peripheral speed and rate of rise of the packer head and the horsepower of the electric power driving the packer head shaft constant but varying the rate of concrete feed to the mold through control of the conveyor speed. The conveyor speed is controlled as a function of a pre-selected horsepower of the motor for the particular pass to deliver concrete to the mold at a rate which insures uniform compaction and density of the formed pipe.

The density to which the concrete is compacted will depend on the force in pounds applied by the packer head. Thus packer head torque, in pound-feet, is a direct measure of force since the circumference of the pipe in feet is essentially fixed. Torque in a DC motor is directly proportional to current. Thus if a DC packer motor is used current measurement will accurately reflect torque. However, because of different motor constants, a given torque will require different currents. In an AC machine, torque is proportional to $I^2R$. In other words, because of the power factor, torque is no longer directly proportional to current. Torque is directly proportional to power in both AC and DC machines.

Thus, in a DC machine current will accurately represent torque and can be used as a control variable in a given apparatus. However, current values obtained with one machine are not transferable to another. Even in an AC machine, current will give a good approximation since the power factor will not change a great deal in operation.

However, in both cases a value more directly related to torque, and thus packing force, is power. Power can be expressed in watts or, preferably, horsepower. This value is independent of factors which vary from motor to motor such as power factor. Furthermore, if no load horsepower is subtracted from a measured value of horsepower, a universally usable reference value hereinafter call corrected power for uniform packing is obtained.

The apparatus of the present invention can be operated in three ways, manually, semi-automatically and automatically, with or without the aid of a computer. The computer can be used to particular advantage in coordinating all mechanical functions of the apparatus of the invention by adjusting the feed rate of concrete, water, vibration and other critical components involved in the production of the concrete pipe.

The apparatus for carrying out the semi-automatic method of the invention consists of means for setting in a reference speed at which the conveyor motor is to be operated for each pass and thereby vary the feed of concrete for each pass.

In carrying out the automatic method of the invention, the packer head motor horsepower is sensed and used in a feedback loop to maintain a constant power consumption. Horsepower is first zeroed out with respect to loads due to drive train and transmission, and for losses due to friction and motor efficiency and the packer head is positioned at the bottom of the mold. The reference value corresponding to a desired horsepower for the first pass is then selected. The peripheral speed of the packer head is maintained constant by the motor and a rate of rise of the packer head is selected which is constant.

The conveyor motor responds to the motor horsepower selected for the first pass and concrete is added to the mold from the conveyor. The rise of the packer head is begun when sufficient concrete is added to the mold to begin the concrete pipe forming operation. At the end of the rise the conveyor motor is stopped. The packer head is then lowered down again into the mold to complete the first pass. The second pass is begun by selecting a predetermined horsepower of the packer head motor for the second pass. The conveyor motor responds to this selected horsepower and adds concrete to the mold at a rate of feed significantly less than the rate of feed of the first pass. The rise of the packer head is begun at the same rate of rise as in the first pass and the pipe formation is complete.

The formation of concrete pipe of uniform density is accomplished by the above method and apparatus by employing a predetermined horsepower of the packer head motor for each pass to insure uniform compaction of concrete in the mold. The predetermined horsepower controls the conveyor motor by means of the feedback circuit to add the necessary amount of concrete to effect uniform compaction. The packer head speed, and rate of packer head rise, and motor horsepower remain constant for each pass; only the conveyor motor speed is varied. The values for these constants vary with the type of concrete pipe produced, its dimensions and the degree of compaction desired. For example, in making concrete pipe having an inner diameter of 15 inches and a length of 8 feet, the predetermined horsepower can be about 40 for the first and second pass. The peripheral speed of the packer head can be maintained at about 1300 ft. per second and the rate of rise of the packer head can be ½ ft. per second.

It has been found that concrete pipe can be formed at a rate of 536 to 540 units per eight hour day using the automatic method and apparatus.

DETAILED DESCRIPTION OF THE INVENTION

Figure 1:
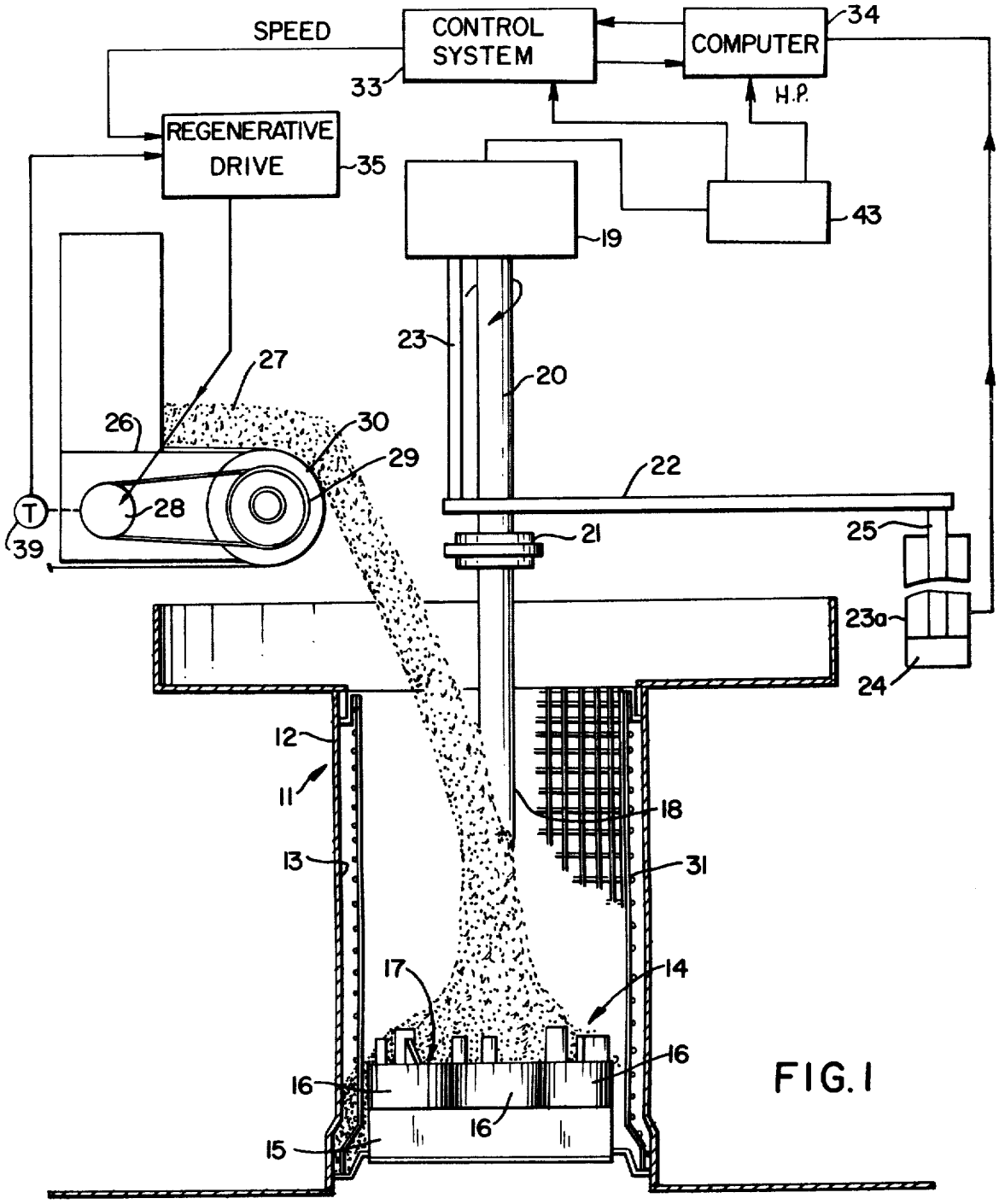
FIG. 1 is a sectional side view of a concrete pipe forming apparatus and control system according to the invention.

FIG. 1 shows a concrete pipe forming apparatus employing a rotating packer head. The apparatus includes a cylindrical mold shown generally by 11 having outer wall 12 and inner wall 13. A packer head shown generally by 14 is located at the bottom of mold 11 which consists of three elements; cylindrical base 15, also known as a long bottom, peripheral rollers 16 disposed above base 15 and top plate 17 which rotatably retains the rollers above the base. The top plate 17 and base 15 are centrally mounted on packer head shaft 18. A packer head driving motor 19 having a motor shaft 20 is located above the mold. The motor shaft 20 is coupled to packer head shaft 18 through coupling 21. Means for raising and lowering the packer head 14 and motor 19 are provided which includes support member 27 through which shaft 20 is journalled and motor support 23 extending upwardly from support member 22 to motor 19. Shaft 20 and thus shaft 18 as well as motor 19 are lifted and lowered by hydraulic cylinder **23*a* which includes piston 24 and rod 25 mounted on support member 22**.

The apparatus further includes conveyor 26 for feeding concrete 27 into the mold. The conveyor is driven by conveyor motor 28 which is connected to sheave 29 on the end of conveyor pulley 30. A wire cylindrical cage 31 is located in the mold for making reinforced concrete pipe. The apparatus as essentially described above is known in the art and can be purchased from Concrete Pipe Machinery Company of Sioux City, Iowa.

Figure 2:
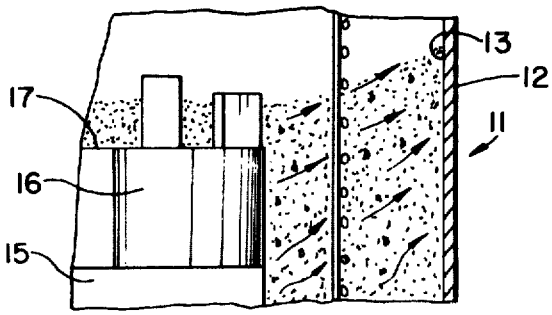
FIG. 2 shows a bottom section of the concrete pipe forming apparatus of FIG. 1.

In operation, for a two pass system, the packer head 14 is placed at the bottom of the mold as shown in FIG. 1 Concrete is added to the mold by means of conveyor 26 and the packer head is rotated and lifted thereby compacting the added concrete between the packer head and mold inner wall 13, as shown by the arrows in FIG. 2. When the packer head reaches the top of the mold, a pipe is formed of roughly the dimensions and surface characteristics desired. Concrete addition is then halted. On the second pass the packer head is placed at the bottom of the mold and the above operation is repeated with the exception that the concrete feed rate is less than in the first pass. The rotation and raising of the packer head in the second pass performs a finishing operation on the inside surface of the roughly formed pipe made in the first pass using additional concrete.

FIG. 1 shows a block diagram of electronic apparatus for measuring the horsepower generated in the packer head 14, and for controlling the speed of conveyor motor 28 as a function of the measured horsepower to produce concrete pipe of uniform density.

In general, control system 33 supplies a speed signal to regenerative drive 35 where it is used along with a feedback signal from a tachometer 30 to maintain the selected speed at conveyor motor 28. A horsepower measuring device 43 measures the power consumption of packer motor 19 and supplies it to control system 33 where it is compared with a desired horsepower valve and the difference between the two used to adjust the desired speed signal in a direction such as to maintain constant horsepower.

Inputs are also provided to a computer 34 which can control operation of the various system elements. In particular, computer 34 subtracts from the output of horesepower measuring device 43 the no-load horsepower providing a corrected value to control system 33.

Figure 3:
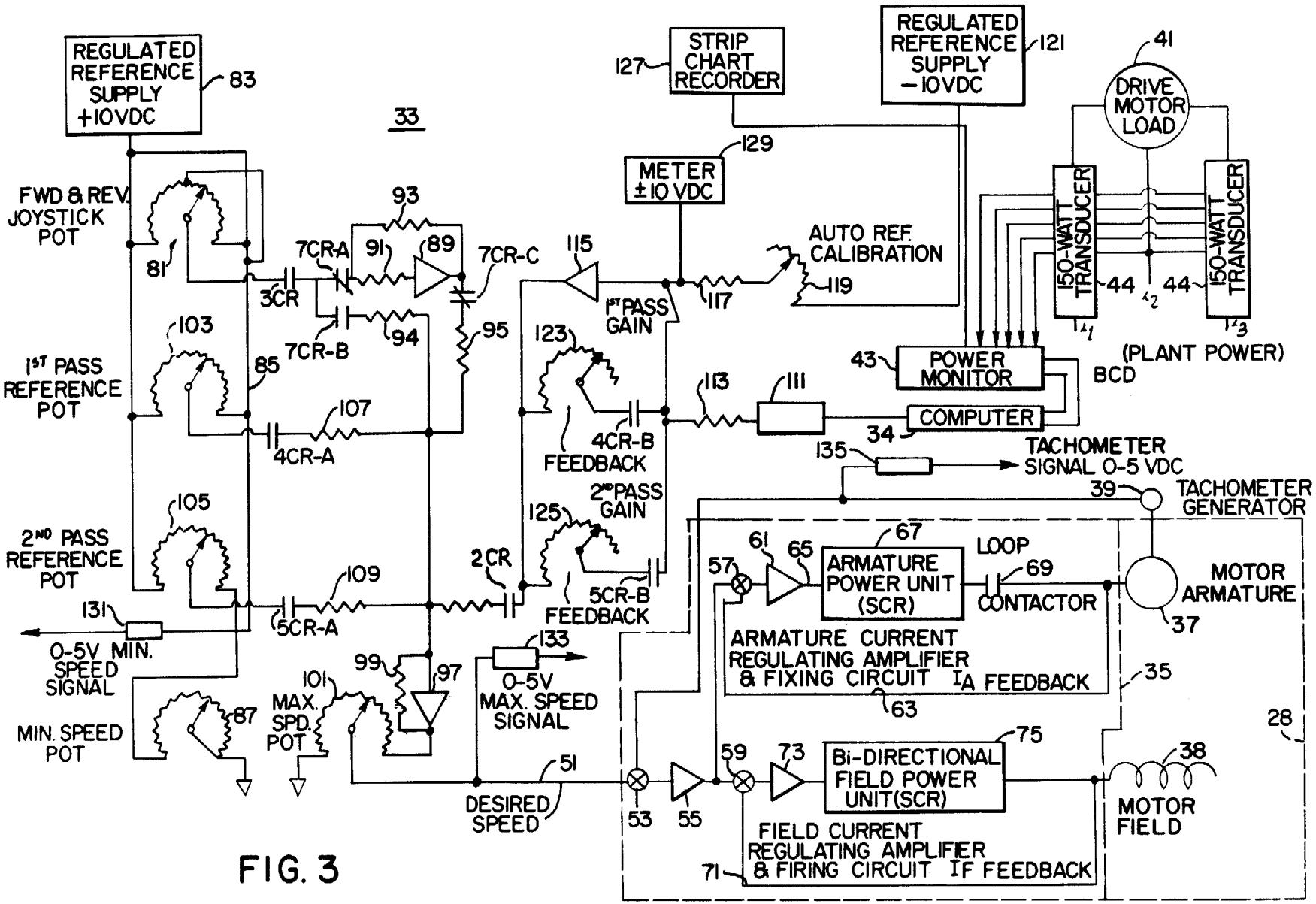
FIG. 3 is a circuit diagram of the control system of the present invention.

FIG. 3 is a circuit diagram of an embodiment of a control system for the apparatus of FIG. 1. With the embodiment, three modes of operation of the apparatus of FIG. 1 are possible. In each case, the speed of the motor 28 driving the conveyor 26 feeding the concrete into the mold is controlled. The motor, in conventional fashion, as shown by FIG. 3 includes an armature 37 and field 38. The motor is driven by a regenerative drive 35 in the illustrated embodiment. Essentially, any speed control can be used. It has been found, however, that a regenerative drive, such as that sold under the trademark Speedpac and made the Allen Bradley Company works particularly well. The regenerative control 35 receives a desired speed as an input on line 51. The desired speed on line 51 is compared at a summing junction 53 with a feedback speed signal from a tachometer 39 which is mechanically coupled to the motor armature 37. The resulting error signal is amplified in an amplifier 55 and fed to two further summing junctions 57 and 59 respectively. Summing junction 57 is at the input of amplifier 61. At this summing junction, the signal from amplifier 55 is compared with a feedback signal indicating motor armature current. The error between a desired motor armature current as determined by the output of amplifier 55 and actual motor armature content as indicated by the feedback on line 63 is amplified and provided on line 65 as an input to an armature power unit 67 which includes SCR's, i.e., thyristors and operates in conventional fashion. The output of the power unit 67 is coupled through a loop contactor 69 to the motor armature.

The output of amplifier 55 is also a reference input to the summing junction 59 where it is compared with feedback indicative of actual motor field current on line 71. The error after amplification in amplifier 73 is used as a control input to a bi-directional field power unit 75 which controls the motor field current and controls forward and reverse operation.

The speed signal on line 51 can be developed in a number of different manners. Operation can be carried out completely manually, what will be referred to herein as semiautomatically and, finally, in an automatic fashion in which the amount of concrete fed to the mold is a function of the horsepower of the drive motor 41. This last method provides, in accordance with the present invention, increased speed of operation as well as, at the same time, providing a better product.

Manual operation is carried out by means of a forward and reverse joy stick potentiometer 81. Potentiometer 81 has its two ends coupled to a plus 10 volts regulated DC supply 83. It has a center tap coupled, over line 85, to a minimum speed potentiometer 87. Potentiometer 87 has its one end and wiper coupled together and to ground so as to provide a variable series resistance to ground. The other end of the ptentiometer is coupled to line 85 which supplies the minimum speed signal. In effect, this insures that even with the potentiometer 81 set at the center or nominal zero speed position there will be a minimum speed signal generated. The potentiometer 81, as indicated, is a joy stick potentiometer. In addition to the potentiometer connected to a joy stick, there are also switch contacts. Asssociated with the joy stick pot 81 are set of contacts designated 3CR and set of contacts designated 7CR, a, b and c. These may be direct contacts or may be coupled through relays. Contact 3CR is normally open. Contacts 7CR a and c are normally closed and 7CR b is normally open. Contact 3CR is a contact indicating the the joy stick is in use. Contact 7CR a, b and c are contacts indicative of a forward or reverse condition. Thus, when a joy stick is operated, contact 3CR closes. The normally closed condition of contact 7CR a and c indicates reverse. Thus, if the joy stick is being operated for forward drive, these normally closed contacts will be opened and contact 7CR b will be closed. Contact 7CR a couples the output of potentiometer 81 into an amplifier 89. The input is coupled in through a resistor 91 with amplifier 89 having a feedback resistor 93. The sole purpose of amplifier 89 is to invert the signal for a reverse condition. Normally, all operations of the conveyor belt are carried out in the forward feed direction. Only for maintenance purposes or the like is the conveyor reversed. This is always done manually with the joy stick control. Thus, normally the potentiometer, and the other devices can be described below provide a positive signal, between zero and plus 10 volts, on line 51. However, when operated in reverse, the positive signal generated by the joy stick pot 81 is inverted through the amplifier 89 to provide a negative input reference signal on line 51.

Following the path of the signal, either a positive signal for forward drive is provided, through a resistor 94 or negative signal for reverse drive through a resistor 95 to the input of a summing amplifier 97 having a feedback resistor 89. The output of amplifier 97 is coupled through a maximum speed potentiometer 101 to the desired speed input line 51. This potentiometer insures limiting to a maximum speed. Thus, in manual operation, movement of the wiper of potentiometer 81 will ultimately vary the voltage on line a51 provided an input desired speed which will be used in the regenerative control 35 to provide appropriate signals for the motor armature and field to maintain a speed proportional to that set in on the potentiometer 81. This constitutes manual operation.

The second type of operation is what is designated as semiautomatic operation. Shown directly below the manual joy stick pot 81 is a first pass reference potentiometer 103 and a second pass reference potentiometer 105. These potentiometers, similarly to potentiometer 81 are coupled between the plus 10 volts DC and the minimum speed signal on line 85. They are precision potentiometers and are set for a desired speed on the first and second passes.

The apparatus includes switches to select the first and second passes. These may be manually operated switches or automatically control switches, e.g., controlled by the computer 34 of FIG. 1. Switches 4CR and 5CR indicative of the first and second passes respectively are interlocked with switch 3CR so that these switches, even if otherwise selected, will be opened upon the operation of the joy stick pot 81. During semiautomatic operation, during the first pass, switch 4CR-a will be closed and during the second pass switch 5CR-a will close. The outputs of one of the respective pots 103 or 105 will be fed through an input resistor 107 or 109 to amplifier 97 and provide a reference speed input on line 51.

In fully automatic operation, the feed is controlled as a function of the horsepower of the drive motor 41. As shown in FIG. 3, the drive motor 41 is supplied with three phase power from the plant power lines. Power is monitored by a power monitor 43. A unit which have been found to be particularly good is the Valenite Power Monitor HPM 100 manufactured by the Valenite Division of the Valeron Corporation of Michigan. Associated with the unit are two Isowatt transducers 44 which provide inputs to the power monitor. These are units which monitor the voltage and current in two of the lines along with phase information so that the output of power monitor 43 accurately indicates horsepower. Other powering measuring units can be used. The more accurately a unit measures horsepower, the more suitable it is for use in the present system. However, it should be noted that measuring devices which approximately measure power, such as by measuring current can be used although not as successfully. It is thought that the ability to measure horsepower is particularly significant in relating results obtained at one plant to another plant. Since horsepower relates directly to packing of the material, it will remain unchanged irrespective of variations in voltages, type of motors and so forth thus permitting information relating to the manufacture of pipe derived at one plant be transferred to another plant. The particular power monitor mentioned above provides a zero to two volts DC output representing, for example, zero to 60 horsepower or zero to 150 horsepower. Since the system operates on zero to 10 volts DC, apparatus to convert this voltage must be provided it if is used directly. The power monitor also has a BCD output. Preferably, as shown, this output from the power monitor 43 is fed into the computer 34 and a reference output from the computer obtained through an appropriate ditigal analog converter 111 scaled between zero and 10 volts. This is particularly beneficial since it permits zeroing out the drive system before it is loaded using the computer. In other words, the amount of measured horsepower load which is attributed to losses in the drive train and not to actual work being done in packing concrete can be subtracted out to obtain corrected power. This can be done in a simple fashion with the computer in a manner to be described in more detail below to give more accurate measurements. Such can also be done by hand. However, it is more difficult and in the long run does not provide the same accuracy.

The horsepower output signal from the computer is coupled through an input resistor 113 to an amplifier 115. At the input of the amplifier 115 it is summed with an input coupled through an input resistor 117, from an auto reference calibration potentiometer 119 receiving as its input minus 10 volts DC from a regulated reference supply 121. Feedback resistors for amplifier 115 are in the form of potentiometer 123 for the first pass and potentiometer 125 for the second pass. These are coupled into the circuit through contacts 4CR-b and 5CR-b respectively. When operating automatically, contacts 2CR at the output of amplifier 115 are closed in order to bring the horsepower feedback into the loop.

Figure 3A:
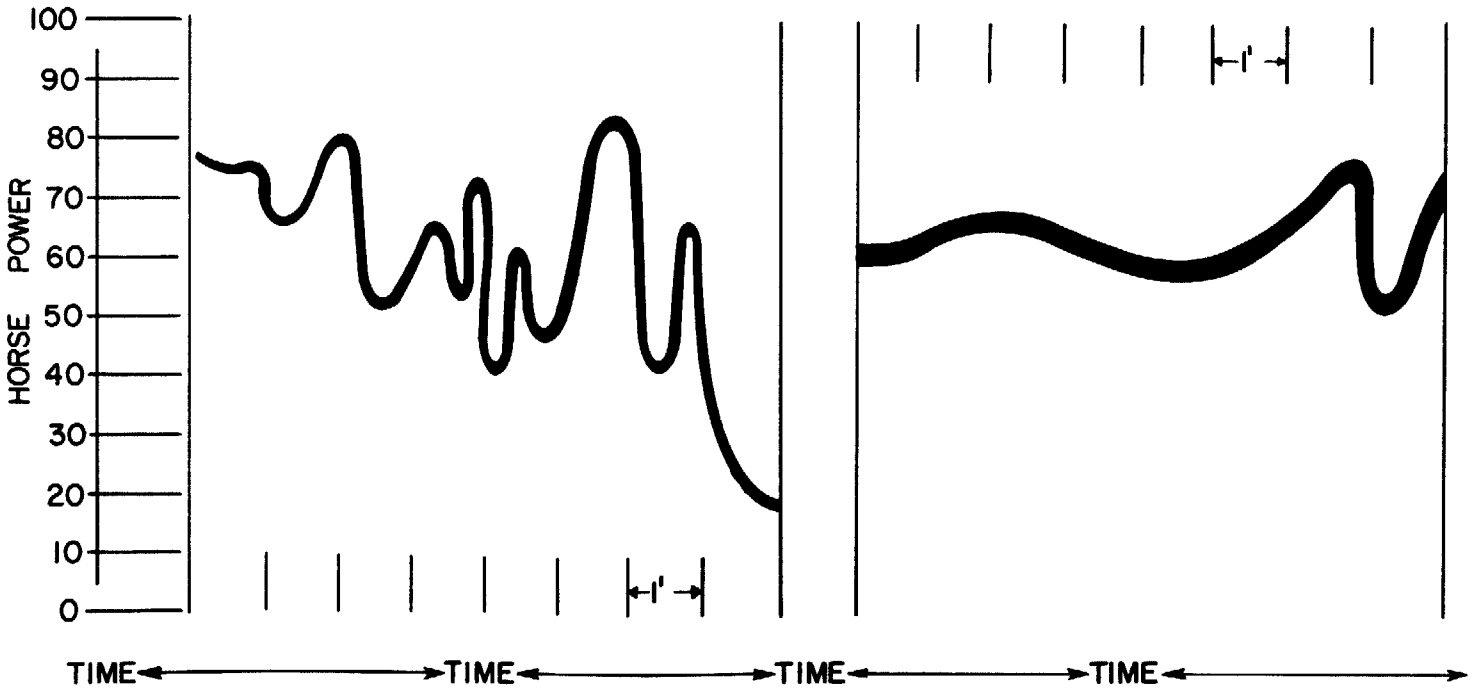
FIG. 3A is a strip chart recording comparing automatic and manual operation.

To understand how the system operates automatically with horespower feedback, the manner of setting up the system for automatic operation will be discussed. First of all, it should be noted that a strip chart recorder 127 is coupled to the output of the power monitor so that the operation over the formation of a total pipe can be examined. In setting up the system, the contacts 2CR are held open and one of the reference potentiometer 103 or 105 set to give, at the output of the power monitor, which has a digital display, the desired horsepower value. With the desired horsepower output, potentiometer 119 is set so that voltage reading on a meter 129 at the input of amplifier 115 is zero. In other words, the reference signal from potentiometer 119 is set to be equal to the actual measured horesepower signal at a time when the desired horsepower is being generated. This can also be accomplished utilizing the joy stick pot 81 to manually control to a constant horsepower while operating the power monitor. Now that the calibration pot 119 is set, the contacts 2CR may be closed. As long as the measured horsepower equals the desired horsepower, there will be a zero input to amplifier 115 and a zero output. However, should actual horsepower deviate from desired horsepower an error will result. This error is summed with the desired speed signal generated in one of the pots 103 or 105 at the input of amplifier 97 and thus adjust the speed signal on line 51 up or down so that the conveyor is driven faster or slower to supply more or less material so as to increase or decrease the horsepower as desired to maintain it at a constant value. The error signals developed at the input to amplifier 115 will be amplified in dependence on the setting of the gain as determined by potentiometer 123 or 125. This will affect the response of the system. It is here that the strip chart recorder is of great benefit. By observing the strip chart recorder one can see how quickly the variations damp out. The improved performance and the manner in which damping can be observed is illustrated by the strip chart recording of FIG. 3A in which the first pass was done automatically and the second manually. Using this information the gains can be set at the potentiometers 123 and 125 to obtain optimum system performance. Any small variations in desired horsepower once set in, can be adjusted out through a slight adjustment of the potentiometer 103 or 105. Basically, an increase in speed will result in an increase in horsepower. Thus, it becomes possible to adjust the system to operate at constant horsepower. What this means is there will be a constant packing density over the length of the pipe. The pipe will be made more uniformly and can be made more quickly than was possible manually. For example, in the industry an operator can make, on the average, 250 8 foot long, 15 inch ID, pipes in a eight hour day. With the system of the present invention, it is possible to make between 535 and 540 pipes of this nature. Furthermore, the pipes made with the automatic system of the present invention are of better quality and a better consistency than those made manually by an operator.

As illustrated the miniumum speed signal is coupled through a zero to 5 volt converter 131, the maximum speed through a zero to 5 volt converter and tachometer generator 39 through a zero to 5 volt converter 135. Each of these signals is fed to the computer 34 of FIG. 1. In addition, the signals from other potentiometers, etc., can also be fed to the computer and, what is done through the analog elements, e.g., amplifiers 89, 97, and in particular amplifier 115 with its gain pots 123 and 125 carried out in the computer with the computer generating a signal input to the summing junction 51 necessary to maintain a constant horsepower. Although such a system is possible and can be designed to take into account the transfer function of the system under consideration, it is found that good results are obtainable with the analog arrangement as illustrated by FIG. 3. The invention, however, is not limited to this implementation.

In the present implementation, the computer is used primarily to perform functions formerly performed by relay logic in systems of this nature. In addition, as noted above, the computer also zeroes out the horsepower. This ability is quite significant in its contribution in the universal use of information derived in one system in other pipe plants throughout the country. If horsepower reading can be related only to power used for packing of pipe and all other factors eliminated, it will be useful in any plant irrespective of drive train losses, type of motor, etc.

As noted above, the computer is used primarily to carry out relay logic type functions. A computer particularly useful for this purpose and which is designed for ease of programming of such is the Allen Bradley PLC Microprocessor. Preferably, this computer will receive inputs from the joy stick pot 81 indicative of operation and forward or reverse, will receive inputs from appropriate switches indicating auto or manual operation and the like and along with the other inputs indicated on the Figure and a BCD input which is provided out of the power monitor 43.

Figure 4:
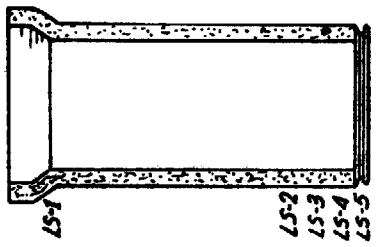
FIG. 4 is a diagram showing the location of limit switches at the mold.
Figure 5:
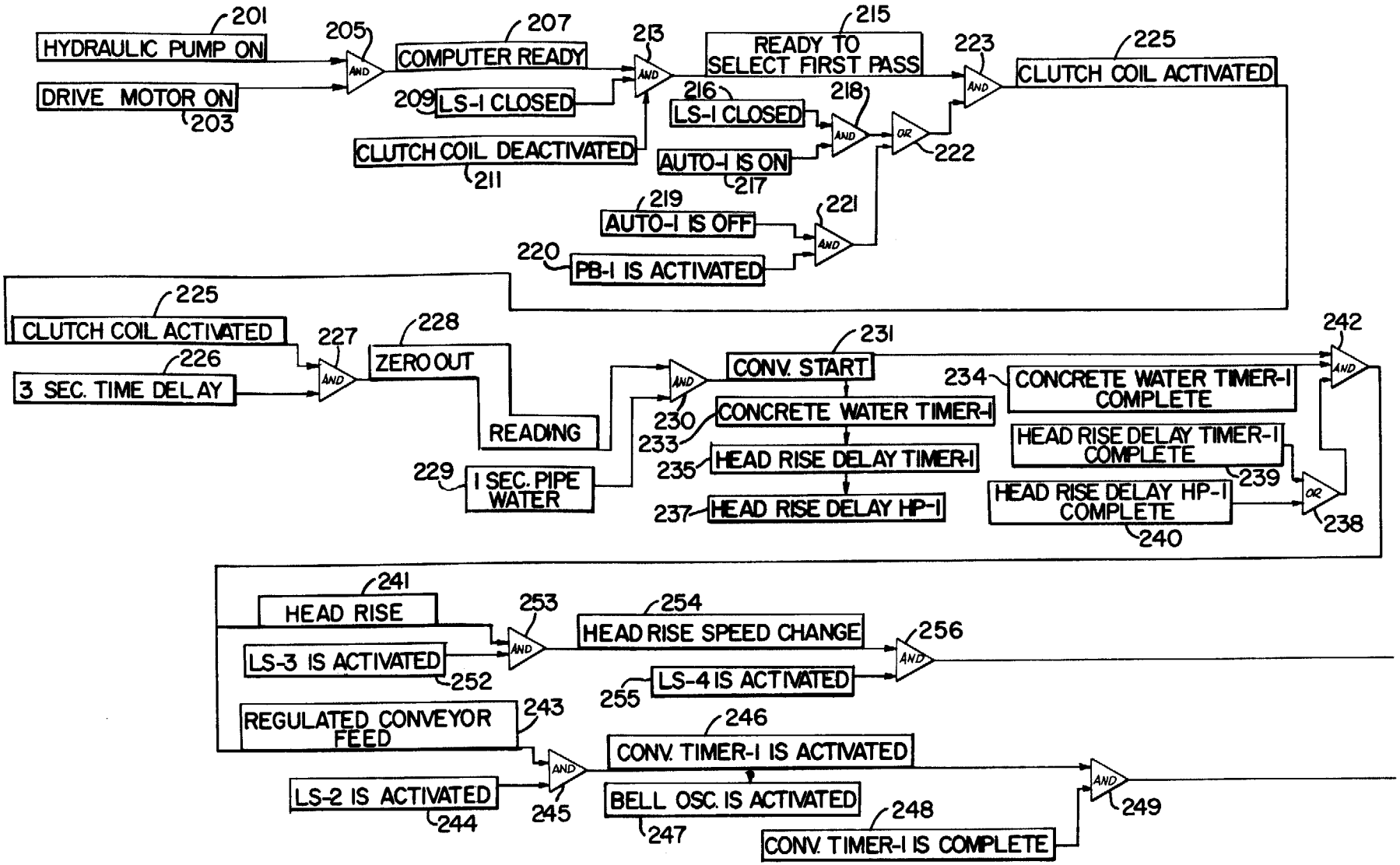
FIGS. 5 and 5(*a*) a flow diagram illustrating the functions performed by the computer.
Figure 5D:
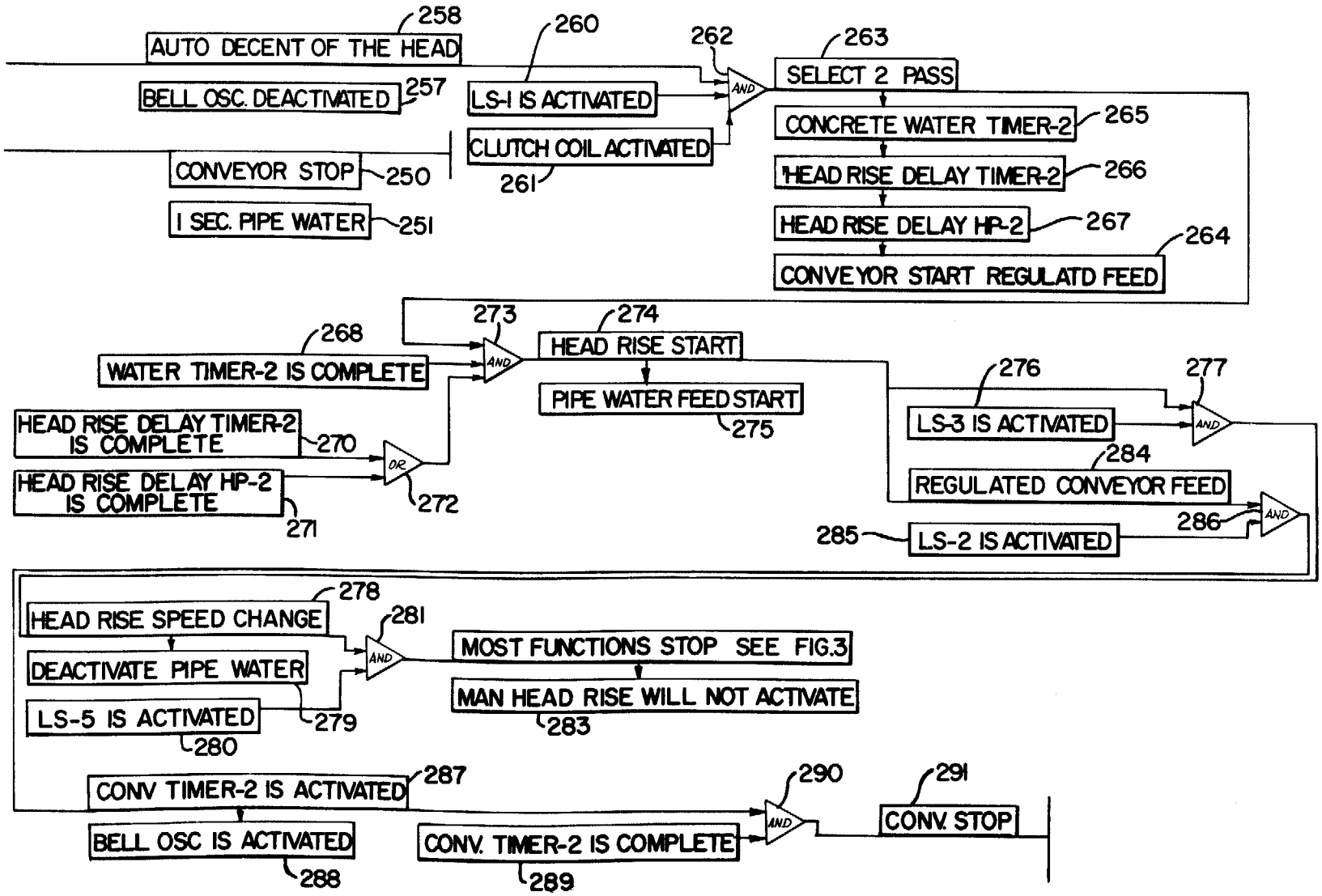

In order to understand the type of operation carried out by the computer reference should be had to FIGS. 4 and 5. FIG. 4 is a diagram showing the location of limit switches in respect to the position of the packer head in the mold. FIG. 5 is a flow diagram of the computer program. Operation normally commences with the packer head in the lowermost position. In order to determine this position, a limit switch is provided in the appropriate location and is designated herein LS-1. It is shown in FIG. 4. As indicated previously, a hydraulic motor typically is used to raise and lower packer head. In addition, there is the drive motor 41 which rotates the packer head. Thus, the computer is set up so that it requires an indication 201 that the hydraulic pump is on and indication 203 that the drive motor is on. These two inputs are Anded in an And block 205 to provide an output 207 designed "computer ready". If this signal is present and if LS-1 is closed as indicated by block 209 and a signal indicating that the clutch coil, i.e., the clutch coil which couples the packer head to the motor shaft is deactivated provided as indicated by block 211, as shown by And function block 213, an indication 215 that the system is "ready to select the first pass" is generated. Now, two possibilities are Ored as indicated by block 222. If LS-1 is closed as indicated by block 216 and auto 1, a switch indicating first pass automatic operation is closed as indicated by block 217, these two inputs being Anded as indicated by block 218, or if auto 1 is off as indicated by block 219 and a switch PB-1 is activated as indicated by block 220, these two functions being Anded as indicated by And block 221, and the condition "ready to select the first pass" of block 215 is present, as indicated by block 223, the clutch coil is activated as indicated by block 225. It should be noted, that switch PB-1 is a manual override switch. When this switch is pushed, the operator takes control away from the computer.

Once the clutch coil is activated a three second time delay is started. If the clutch coil remains activated after the three second time delay as indicated by block 226 at the And operation of block 227, a command to zero the horsepower reading as indicated by block 228 is given, as is one second of pipe water commenced as indicated by block 229. During this period, note that the clutch coil is activated and thus the drive motor is driving the packer head. The horsepower reading which is detected will relate strictly to losses in the system. Thus, by sensing this reading, and storing it, and subtracting it from the actual reading now and during packing, the computer can thereafter provide accurate corrected power outputs. Such outputs will be provided through an appropriate voltage converter 111 as shown in FIG. 3. When both of these functions are carried out as indicated by And block 230, operation basically starts up. The conveyor is started by closing contacts 4CR a and b as indicated by block 231. A concrete water timer 1, head rise delay timer 1 and head rise delay horsepower 1 are started as indicated by blocks 234, 235 and 237 respectively. When the concrete water timer 1 is completed, with the conveyor still running and either head rise delay timer complete or the head rise horsepower complete as indicated by or block 238, receiving the appropriate inputs from blocks 239 and 240, head rise is started and regulated conveyor feed operation takes place as indicated by blocks 241 and 243 responding to the output of and block 242.

Referring to FIG. 4 it can be seen that as the packer head approaches the top of the pipe it encounters the switch LS-2. When LS-2 is activated, as indicated by block 244 and the conveyor is in operation, as sensed by the And operation 245, the conveyor timer 1 is activated as indicated by block 246 and the bell oscillator activated as indicated by block 247. The bell is the element at the top of the pipe which is oscillated at around the time the packing is taking place near the pipe top. When the conveyor timer 1 is completed as indicated by block 248, the conveyor is stopped in response to the output of And block 249 as indicated by block 250 and one second of pipe water is started as indicated by block 251. In the head rise loop, upon further movement above LS-2 to another limit switch LS-3, also shown in FIG. 4, and as indicated by block 252, an output from And block 253 causes a head rise speed change as indicated by block 254. In other words, the head rise is slowed down. With continued movement, limit switch LS-4 is activated as indicated by block 255. Now, as indicated by the output of And block 256, the bell oscillator is deactivated as indicated by block 257 and an auto-descent of the head begins as indicated by block 258.

When the head reaches the bottom, LS-1 is activated as indicated by block 260 with the clutch coil remaining activated as indicated by block 261. In contrast to the beginning of the first pass, the clutch coil is activated.

Thus, based on this difference the output from And operation 262 knows it must select the second pass as indicated by block 263. In selecting the second pass, of course, the contacts 5CR a and 5CR b will be closed to start regulated feed in the conveyor as indicated by block 264. At the same time, in a manner similar to what took place in the first pass, the concrete water timer 2 is started as indicated by block 265, the head rise delay timer 2 as indicated by block 266 and the head rise delay horsepower as indicated by block 267.

It should be noted, that both in the first and second passes, the delay timer and the delay horsepower are important elements. Packing at the bottom takes place first and the packing head must start moving at exactly the right time, otherwise excess material will be packed causing damage to the packer head and mold. In the prior art where things were done manually, head rise was done in response to a timer since the operator could not see to the bottom of the mold. With the system of the present invention, the necessary delay is set in after the start of feed from the conveyor and in addition, the horsepower is measured. If horsepower exceeds a certain valve, i.e., the delay horsepower setting, head rise is started. Thus, if more material then is normal is supplied in a shorter time, even though the time is not completed head rise will start to avoid over pack of pipe.

Operation then continues much in the same manner described below. With the second pass selected, and water timer complete is indicated by block 268 and either head rise timer 2 block 270 completed or the delay horsepower, block 271 completed, through Or operation 272, the And operation indicated by block 273 will have an output "head rise start" 274 and will also cause a pipe water feed 275 to start. Pipe water feed adds a certain amount of lubrication on the second pass. It should be noted, that 90% of the material used in making the pipe is supplied and packed on the first pass and only 10% on the second pass. The second pass is primarily a smoothing operation. Typically, operation on the first pass might be at 1100 RPM on the conveyor belt and on the second pass in a range of 5 RPM. Because of this big difference in conveyor speed, control in the past has been particularly difficult. It can be seen just with these figures how even the semiautomatic system described above provides improvement.

Returning to the flow chart, with head rise being carried out as indicated by block 274, once again, when LS-3 is activated, as indicated by block 276, the output of And operation 277 results in a speed change in the head rise as indicated by block 278 and deactivation of the pipe water as indicated by block 279. Again, when LS-5 is activated as indicated by block 280 the output of the And operation 281 stops most of the functions as can be seen by FIG. 4. In other words, the head rise stopped and, the clutch coil deenergized, etc. In addition, at this point a manual head rise is prevented as indicated by block 283. The output from And operation 273 also started regulated conveyor feed as indicated by block 284. With the feed going and LS-2 activated as indicated by block 285, an output from And operation 286 results. Again, this activates a conveyor timer as indicated by block 287, and activates the bell oscillator as indicated by block 288. When conveyor timer 2 is stopped as indicated by block 289 and output from the And operation 290 is generated causing the conveyor to stop as indicated by block 291.

As noted above, the switch PB-1 permits taking over a certain amount of manual control. The PB-1 functions are relatively detailed and beyond the scope of the present application. Generally, however, these are used to stop operations. For example, if while in the first pass PB-1 is activated, the clutch coil will deactivate to, in effect stop packing. If PB-1 is again activated, the clutch coil will activate and auto mode will resume. Various other combinations of this nature, putting the system in and out of auto operation are possible.

Other program functions which are of particular significance are controls which prevent damage and controls which operate a turntable to permit continuous operation. In plants of this nature, there is a turntable with pair of molds on it. When one pipe is molded the turntable is rotated to bring the other mold beneath the packer head so that an additional pipe can be made.

Figure 6A:
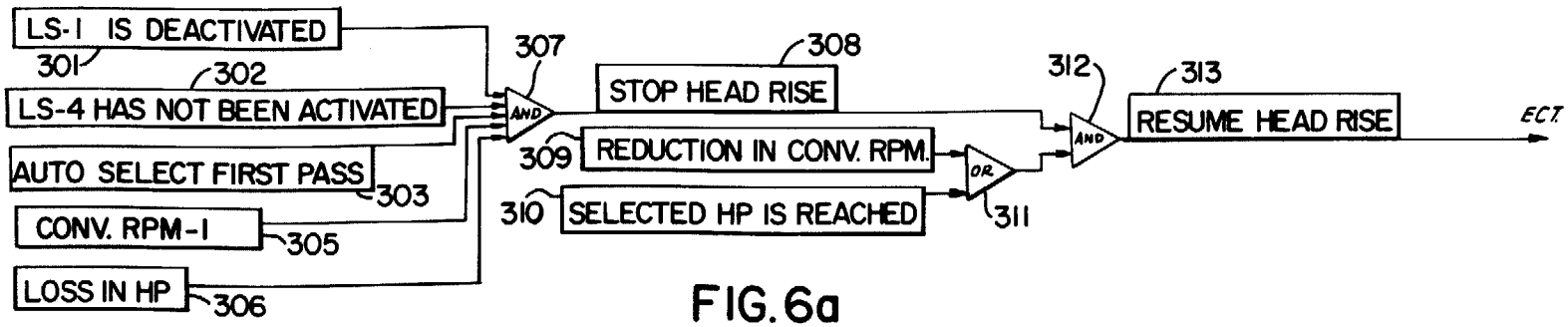
FIGS. 6A–E illustrate headrise control functions.

First, referring to FIGS. 6*a–e* head rise control functions are shown. As indicated in FIG. 6*a*, if LS-1 is deactivated as indicated by block 301 and LS-4 has not been activated as indicated by block 302, auto is selected on the first pass as indicated by block 303, conveyor RPM's are present as indicated by block 305 and loss of at least 4 horsepower as indicated by block 306 is sensed there will be an output from And function 307 which will stop the head rise as indicated by block 308. In other words, this is a situation where the packer head is between the bottom and top, the conveyor is running to supply material and yet there has been a drop of at least 4 horsepower in the output. This means that not enough material is being supplied. Thus, the head rise is stopped until enough material is filled in to reach the desired horsepower or to slow down the conveyor RPM a certain amount. This is indicated by blocks 309 and 310. If the conveyor RPM drops by 5 or if the horsepower is within 2 of that selected as indicated by blocks 309 and/or 310, an output of Or block 311, combined with the fact that the head rise has been stopped provides an output of And block 312 which indicates that head rise is to resume as indicated by block 313.

Figure 6B:
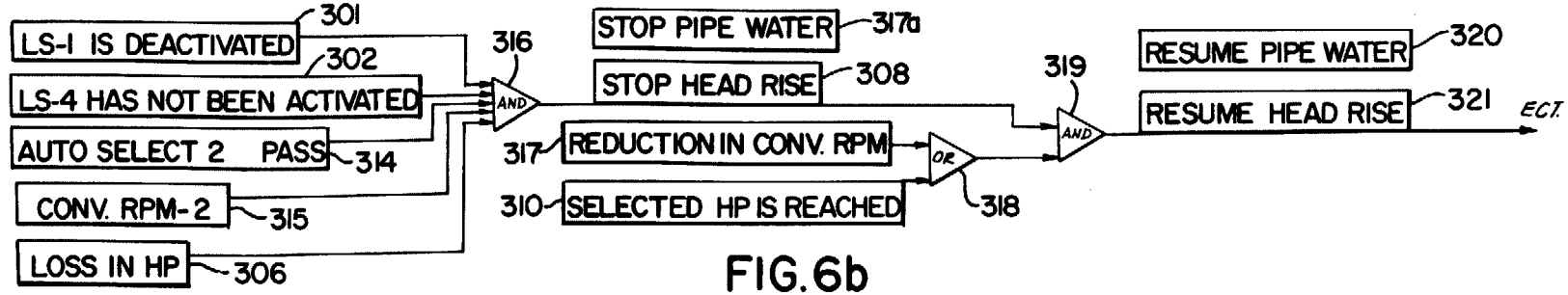

Referring to FIG. 6*b*, if the conditions of blocks 301, 302 are met along with auto select on the second pass as indicated by block 314, conveyor RPM on the second pass, as indicated by block 315 and, again, a loss of horsepower, as indicated by block 306, And block 316 provides an output to stop head rise as indicated by block 308 and also to stop pipe water indicated by block 317*a*. In this operation, again if the conveyor RPM is reduced by at least 1 as indicated by block 317 or if the selected horsepower is reached within 2 as indicated by block 310 an output of Or block 318 is generated. With this output and the fact that pipe water and the head rise have been stopped, there is an output from And block 319 which causes the resumption of pipe water and head rise as indicated by blocks 320 and 321.

Figure 6C:
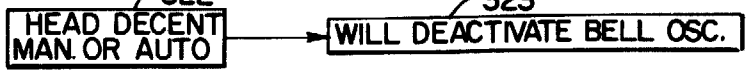
Figure 6D:
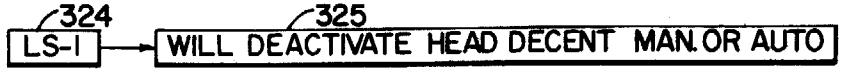
Figure 6E:
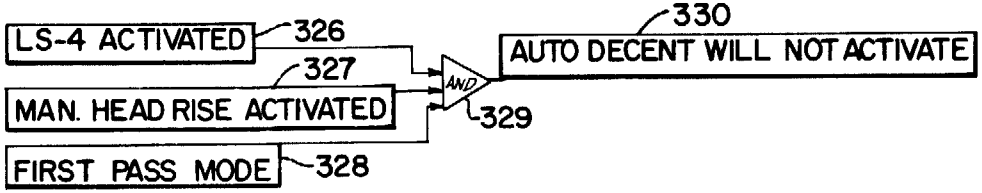

As indicated by FIG. 6*c*, head descent either in manual or auto as indicated by block 322 will automatically deactivate the bell oscillator as indicated by block 323. Similarly, detection of activation of LS-1 as indicated by block 324 will automatically deactivate head descent as indicated by block 325. (FIG. 6*d*) As shown in FIG. 6*e*, if LS-4 is activated as indicated by block 326 and manual head rise activated as indicated by block 327 and the system is in the first pass mode as indicated by block 328, an output from And block 329 will be present indicating that auto descent will not be permitted as shown by block 330.

Figure 7A:
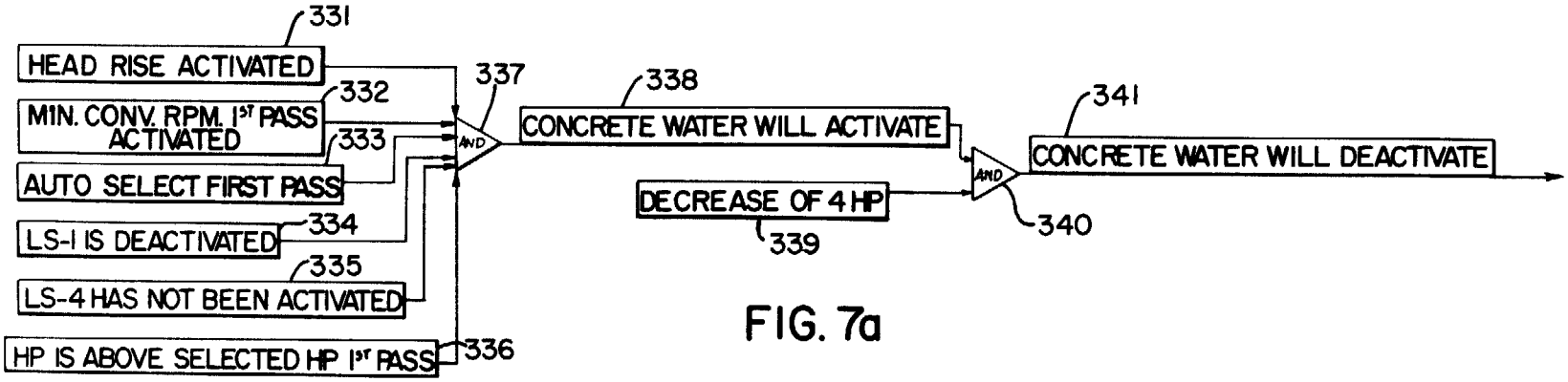
FIGS. 7A–C illustrate conveyor control functions.
Figure 7B:
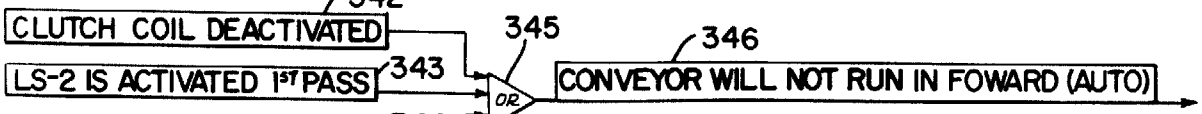
Figure 7C:
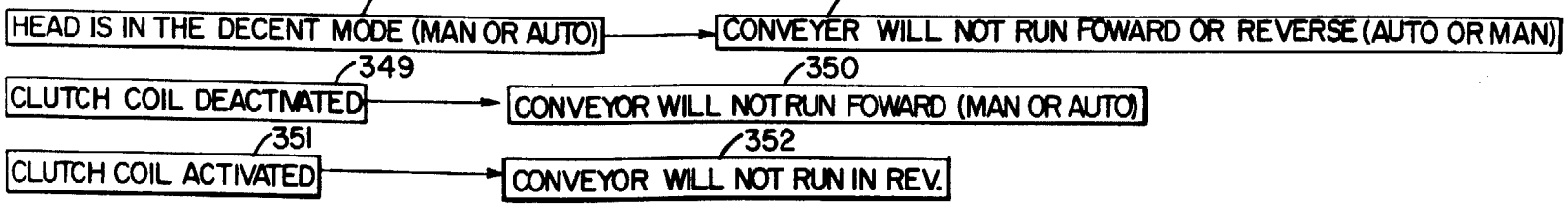

FIGS. 7*a*, 7*b* and 7*c* show some of the conveyor control functions. Thus, as illustrated by FIG. 7*a*, if head rise is activated as indicated by block 331, minimum conveyor RPM on first pass selected as indicated by block 332, auto select first pass as indicated by block 333, LS-1 deactivated as indicated by block 334, LS-4 not yet activated as indicated by block 335 and horsepower is above that selected to the first pass as indicated by block 336, concrete water is activated in response to an output of the And block 337 as indicated by block 338. This provides lubrication which will decrease the horsepower. When a decrease of 4 horsepower detected as indicated by block 339 and that the water is on as indicated by block 338 an output of the And block 340 will deactivate concrete water as indicated by line 341.

In accordance with FIG. 7*b* if the clutch coil is deactivated as indicated by block 342 and LS-2 is activated or LS-2 is activated on the first pass as indicated by block 343 or LS-4 on the second pass as indicated by block 344, an output from OR block 345 will result to prevent the conveyor from running in auto mode as indicated by block 346. As indicated in FIG. 7*c* there are a number of functions which disabled other functions. Thus, if the head is in the descent mode as indicated by block 347 conveyor will not run as indicated by block 348. If the clutch coil is deactivated as indicated by block 349, the conveyor will not run forward as indicated by block 350. If the clutch coil is activated as indicated by block 351, the conveyor will not run in reverse as indicated by block 352.

Figure 8A:
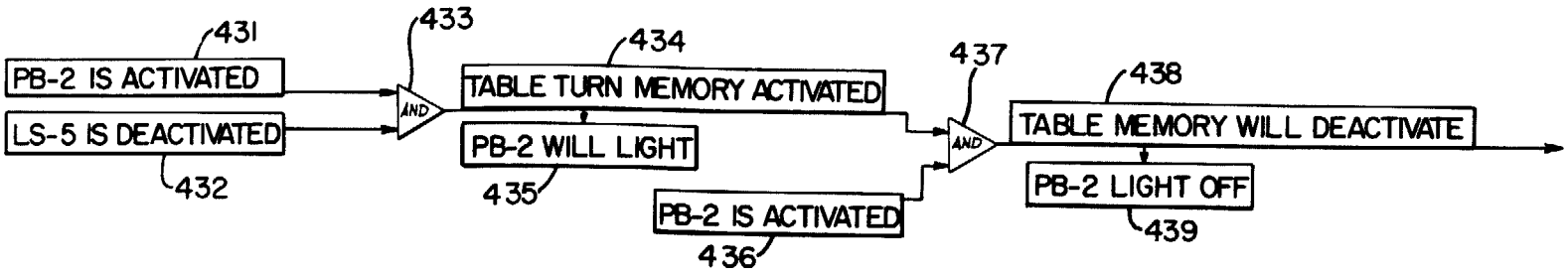
FIGS. 8A–C illustrate table turner functions.
Figure 8B:
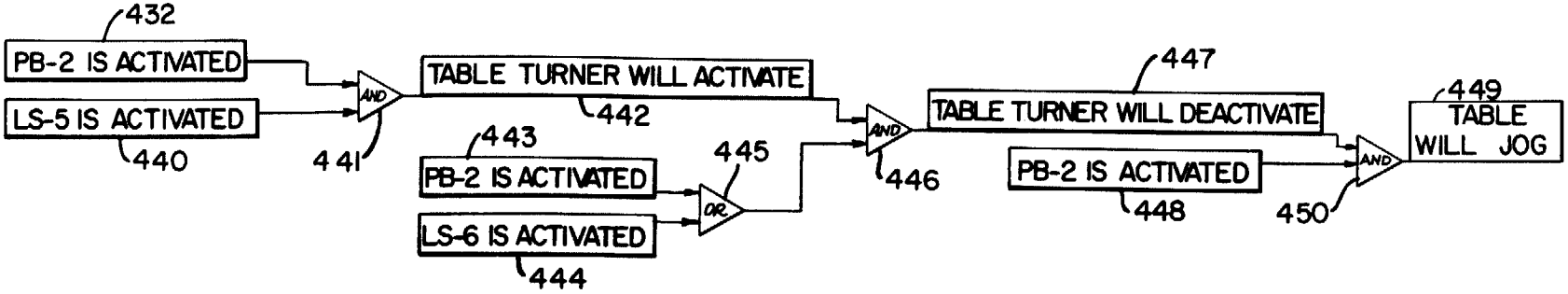
Figure 8C:
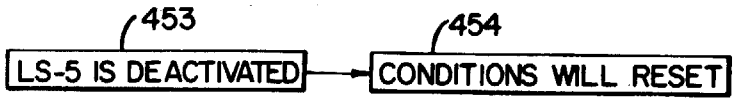

FIGS. 8*a–c* illustrate the logic associated with the table turner. When a push button PB-2 is activated which is a push button which utilized to initiate the table turner function as indicated by block 431 and if LS-5 is deactivated as indicated by block 432, an output from the And function block 433 results to activate the table turn memory as indicated by block 434 and to light PB-2, PB-2 being a lighted switch, as indicated by block 435. If PB-2 is again activated as indicated by block 436, and the turntable memory has been activated as indicated by the output of the And function block 437, the table memory will be deactivated as indicated by block 438 and the light will go off as indicated by block 439. Thus, it can be seen that operating PB-2 will activate and deactivate the memory with an indication being given by means of the light. The operation PB-2 is done in anticipation of the end of cycle of manufacturing pipe. It is done shortly before LS-5 is activated on the second pass. Thus, referring to FIG. 8*b*, as LS-5 is activated as indicated by block 440 and PB-2 is activated as indicated by block 432, an output of And function block 441 results causing the table turner to activate as indicated by block 442. If the table turner has been activated and PB-2 is again activated as indicated by block 443 or LS-6 activated as indicated by block 444 an output, as indicated by Or block 445 which is Anded with the turntable being activated as indicated by block 446, provides an output that deactivates the table turner as indicated by block 447. If under these circumstances PB-2 is now activated as indicated by block 448 and the table turner has been deactivated as indicated by block 447, the table will jog as indicated in block 449, coupled to the output of the And block 450. LS-6, is a limit switch indicating that the required rotation of the table turner to bring the next mold into position has taken place. Finally, as indicated in FIG. 8*c*, if LS-5 is deactivated as indicated by block 443, conditions will reset as indicated by block 454.

What is claimed is:

1. An apparatus for forming concrete pipe of uniform density comprising:

(a) means for forming concrete into the form of said pipe comprising a mold having an inner wall, a packing head for packing concrete against said inner wall, a shaft centrally mounted on said packing head, a packing head motor for revolving said packing head through the mold and means for raising said packing head only at a fixed rate and for lowering said packing head in at least one pass;

(b) means for feeding concrete to said forming means;

(c) a feed motor for driving said concrete feeding means;

(d) means for sensing and measuring the components of the actual power being used by said packing head motor said power being a function of torque generated in said packing head;

(e) means for selecting a desired power;

(f) means for comparing said actual power to said desired power; and (g) means for controlling the speed of said feed motor responsive to said means for comparing.

2. Apparatus according to claim 1 wherein said means for sensing and measuring comprises means for sensing and measuring the components of horsepower.

3. Apparatus according to claim 1 wherein said means for controlling speed comprises a regenerative speed control.

4. A control system for use with apparatus for making a concrete pipe, said apparatus including a mold; a conveyor for feeding concrete to said mold; a motor for driving said conveyor; a packing head for rotating within said mold to distribute and pack concrete supplied by said conveyor; a drive motor for driving said packing head; and means for controllably raising and lower said packing head in first and second passes, comprising:

(a) a speed control for said conveyor motor having a reference speed input and actual speed input and driving said motor such as to minimize the error therebetween;

(b) a tachometer generator for generating a signal representative of the actual speed;

(c) first means for supplying to said speed controller a first signal representative of a desired speed during the first pass; and (d) second means for supplying a second signal representing a desired speed during the second pass.

5. Apparatus according to claim 4 and further including means for establishing a minimum speed and means for establishing a maximum speed coupled to said first and second means for supplying.

6. Apparatus according to claim 5 wherein said speed controller comprises a regenerative speed control.

7. Apparatus according to claim 5 and further including means for manually supplying said desired speed signals to said motor controller and means associate therewith for automatically disconnecting inputs from said first and second means upon operation of said manual input.

8. Apparatus according to claim 5 and further including means for zeroing out the portion of said power which represents drive train and other losses and not power consumed in making pipe at no-load.

9. Apparatus according to claim 8 wherein said means for zeroing power comprises:

(a) a computer programmed to: (i) sense the power output when said packer drive motor is rotating said packer without a load (ii) store said no-load power, and (iii) subtract said no-load power value from the sensed power at all times thereafter, said computer providing as an output the sensed power minus the power sensed with no load; and (b) means to couple the output of said computer as the actual value to said means to compare.

10. Apparatus according to claim 5 and further including: means to select a desired value of power; means to sense a value associated with said drive motor which at least approximately represents power; means to compare said sensed value with said desired value of power and provide as an output an error signal; and means to add said errors signal to said signal representative of desired speed supplied to said speed controller.

11. Apparatus according to claim 10 wherein said power is horsepower.

12. Apparatus according to claim 11 wherein said means to compare comprises an operational amplifier having a summing junction at its input, said amplifier having first and second variable resistors in its feedback path; and means to selectively switch said variable resistors into said feedback path, respectively during said first and second passes.

13. An electronic control system for an apparatus for forming concrete pipe of uniform density which includes: a mold having an inner wall, a packing head for packing concrete against the inner wall, a shaft centrally mounted on the packing head, a packing head motor for revolving the packing head through the mold; means for feeding concrete to the mold; a feed motor for driving the concrete feeding means; means for raising said packing head only at a fixed rate and lowering the packing head in at least one pass, comprising:

(a) means for sensing and measuring the components of the actual power being used by the packing head motor said power being a function of torque generated in said packing head;

(b) means for selecting a desired power;

(c) means for zeroing out the portion of actual power which represents drive train and other losses at no load to obtain corrected power;

(d) means for comparing said corrected power to said desired power; and (e) means for controlling the speed of said feed motor responsive to said means for comparing, such as to cause said actual power to be only constant and thereby said torque to also be constant, whereby said packing head will evenly pack concrete in said mold.

14. A control system for an apparatus for forming concrete pipe of uniform density which includes: a mold having an inner wall; a packing head for packing concrete against the innner wall; a shaft centrally mounted on the packing head; a packing head motor for revolving the packing head through the mold; means for feeding concrete to the mold; a feed motor for driving the concrete feeding means; and means for raising said packing head only at a fixed rate and lowering said packing head in at least one pass, comprising:

(a) means for sensing and measuring the components of the actual power being used by the packing head motor said power being a function of torque generated in said packing head;

(b) means for selecting a desired power;

(c) an operational amplifier having a summing junction at its input, said amplifier having a variable resistor in its feedback path, for comparing said actual power to said desired power; and (d) means for controlling the speed of said feed motor responsive to the output of said operational amplifier, such as to cause said actual power to be only constant and thereby said torque to also be constant, whereby said packing head will evenly pack concrete in said mold.

15. Apparatus according to claim 14 wherein said operational amplifier has first and second variable resistors in its feedback path; and further including means to selectively switch said variable resistors into said feedback path, respectively during first and second passes of said packing head.

16. An apparatus for forming concrete pipe of uniform density comprising:

(a) means for forming concrete into the form of said pipe comprising a mold having an inner wall, a packing head for packing concrete against said inner wall, a shaft centrally mounted on said packing head, a packing head motor for revolving said packing head through the mold and means for raising said packing head only at a fixed rate and lowering said packing head in at least one pass;

(b) means for feeding concrete to said forming means;

(c) a feed motor for driving said concrete feeding means;

(d) means for sensing and measuring the components of the actual power being used by said packing head motor said power being a function of torque generated in said packing head;

(e) means for selecting a desired power;

(f) an operational amplifier having a summing junction at its input, said amplifier having a variable resistor in its feedback path for comparing said actual power to said desired power; and (g) means for controlling the speed of said feed motor responsive to the output of said operational amplifier.

17. Apparatus according to claim 16 wherein said operational amplifier has first and second variable resistors in its feedback path; and further including means to selectively switch said variable resistors into said feedback path, respectively during first and second passes.

18. An apparatus for forming concrete pipe of uniform density comprising:

(a) means for forming concrete into the form of said pipe comprising a mold having an inner wall, a packing head for packing concrete against said inner wall, a shaft centrally mounted on said packing head, a packing head motor for revolving said packing head through the mold and means for raising said packing head only at a fixed rate and lowering said packing head in at least one pass;

(b) means for feeding concrete to said forming means;

(c) a feed motor for driving said concrete feeding means;

(d) means for sensing and measuring the components of the actual power being used by said packing head motor said power being a function of torque generated in said packing head;

(e) means for selecting a desired power;

(f) means for zeroing out the portion of actual power which represents drive train and other losses at no load to obtain corrected power;

(g) means for comparing said corrected power to said desired power; and (h) means for controlling the speed of said feed motor responsive to said means for comparing.

19. Apparatus according to claim 18 wherein said means for zeroing power comprises:

(a) a computer programmed to: (i) sense the actual power output when said packer drive motor is rotating said packer without a load to obtain no-load power; (ii) store said no-load power, and (iii) subtract said no-load power from the sensed actual power at all times thereafter, to provide said corrected power, said computer providing as an output said corrected power; and (b) means to couple said corrected power output of said computer as the actual power input to said means for comparing.

20. Apparatus according to claim 18 wherein said means for zeroing power comprises:

(a) a computer programmed to: (i) sense the actual power output when said packer drive motor is rotating said packing head with no-load to obtain no-load power; (ii) store said no-load power; and (iii) subtract said no-load power from the sensed actual power at all times thereafter, to provide said corrected power as an output; and (b) means to couple said corrected power output of said computer as the actual power input to said means for comparing.

21. An electronic control system for an apparatus for forming concrete pipe of uniform density which includes a mold having an inner wall, a packing head for packing concrete against the inner wall, a shaft centrally mounted on the packing head, a packing head motor for revolving the packing head through the mold; means for feeding concrete to the mold; a feed motor for driving the concrete feeding means; and means for raising said packing head only at a fixed rate and for lowering said packing head in at least one pass, comprising:

(a) means for sensing and measuring the components of the actual power being used by the packing head motor said power being a function of torque generated in said packing head;

(b) means for selecting a desired power;

(c) means for comparing said sensed power to said desired power; and (d) means for controlling the speed of said feed motor responsive to said means for comparing, such as to cause said actual power to be only constant and thereby said torque to also be constant, whereby said packing head will evenly pack concrete in said mold.

22. Apparatus according to claim 21 wherein said means for sensing and measuring comprises means for sensing and measuring the components of horsepower.

23. Apparatus according to claim 21 wherein said speed controller comprises a regenerative speed control.

24. Apparatus according to claim 21 and further including means for zeroing out the portion of said actual power which represents drive train and other losses, at no-load, to obtain corrected power.

* * * * *

UNITED STATES PATENT AND TRADEMARK OFFICE

CERTIFICATE OF CORRECTION

PATENT NO. : 4,406,605

DATED : September 27, 1983

INVENTOR(S) : George E. Hand

It is certified that error appears in the above-identified patent and that said Letters Patent are hereby corrected as shown below:

In column 5, line 51, change "content" to - - current - -.

In column 6, line 52, change "89" to - - 99 - -.

Signed and Sealed this

Seventh Day of February 1984

[SEAL]

*Attest:*

GERALD J. MOSSINGHOFF

*Attesting Officer*

*Commissioner of Patents and Trademarks*

425-145 SR
CCCB3 OR 4,406,605

REEXAMINATION CERTIFICATE (590th)

United States Patent [19] [11] B1 4,406,605

Hand [45] Certificate Issued Nov. 4, 1986

[54] APPARATUS FOR FORMING CONCRETE PIPE OF UNIFORM DENSITY INCLUDING CONTROL MEANS TO VARY FEED RATE OF CONCRETE/AGGREGATE AS FUNCTION OF PACKERHEAD TORQUE

[75] Inventor: George E. Hand, Williamstown, N.J.

[73] Assignee: Kerr Concrete Pipe Company, Folsom, N.J.

Reexamination Request:
No. 90/000,579, Jun. 25, 1984

Reexamination Certificate for:

| | |
|---|---|
| Patent No.: | **4,406,605** |
| Issued: | **Sep. 27, 1983** |
| Appl. No.: | **188,032** |
| Filed: | **Sep. 17, 1980** |

Certificate of Correction issued Feb. 7, 1984.

Related U.S. Application Data

[63] Continuation-in-part of Ser. No. 39,316, May 16, 1979, Pat. No. 4,336,013.

[51] Int. Cl.[4] ..... B28B 3/18; B28B 21/24

[52] U.S. Cl. ..... 425/145; 318/39; 318/77; 364/469; 364/511; 425/150; 425/262; 425/427; 425/449; 425/457

[58] Field of Search ..... 425/262, 145, 150, 427, 425/449, 457; 264/40.5, 40.7; 318/39, 77; 364/469, 511

[56] References Cited

U.S. PATENT DOCUMENTS

| | | | |
|---|---|---|---|
| 1,904,094 | 4/1933 | Snyder | 425/262 |
| 2,443,656 | 6/1948 | King | 318/39 |
| 2,758,352 | 8/1956 | Perkins | 25/38 |
| 2,766,939 | 10/1956 | Weston | 241/19 |
| 2,834,362 | 5/1958 | Gorrie et al. | 137/86 |
| 3,125,714 | 3/1964 | Eisengrein | 318/454 |
| 3,325,710 | 6/1967 | Reynolds | 318/39 |
| 3,329,806 | 7/1967 | McCauley | 235/92 |
| 3,339,129 | 8/1967 | Bulman et al. | 317/235 |
| 3,459,378 | 8/1969 | Hill | 241/35 |
| 3,600,003 | 5/1972 | Waddington | 425/427 |
| 3,619,872 | 11/1971 | Fosse | 425/426 |
| 3,626,262 | 12/1971 | Kelling | 318/39 |
| 3,632,270 | 1/1972 | Baker | 425/365 |
| 3,662,437 | 5/1972 | Long | 425/147 |
| 3,680,580 | 8/1972 | Beardsley et al. | 137/86 |
| 3,693,645 | 9/1972 | Ogawa | 137/86 |
| 3,746,494 | 7/1973 | Gauger | 425/262 |
| 3,855,511 | 12/1974 | Smith | 318/317 |
| 3,942,114 | 3/1976 | Keeling | 324/177 |
| 3,991,984 | 11/1976 | Porter | 259/195 |
| 4,237,408 | 12/1980 | Frecka | 364/475 |
| 4,249,113 | 2/1981 | Werner | 318/39 |
| 4,334,848 | 6/1982 | Gross et al. | 425/262 |
| 4,340,553 | 7/1982 | Fosse | 264/40.7 |
| 4,407,648 | 10/1983 | Fosse | 425/457 |

OTHER PUBLICATIONS

Graber & Wening Brochures-2/72 and 8/76.
Anon, Hydrotile News, Jan., 1980, Issue #63.
Anon, Hydrotile News, Mar., 1980, Issue No. 1.
Anon, The Simplicity of Fauver Drive-Trol.
Anon, Fauver Drive-Trol Single Amplifier Board Assembly Part #21502, Figs. 4 & 20.
Anon, Fauver Drive-Trol Remote Input Board Assembly Part #21505, Figs. 7 & 23.
Anon, Fauver Drive-Trol Tachometer Feedback Cord Part #21506A, Figs. 8, 24 & 25.
Anon, Fauver Drive-Trol Fast Zero Card Part #21511 Figs. 13 & 26.
Anon, Fauver Drive-Trol Current Converter, 5MA Part #21512 Figs. 14 & 27.
Anon, Fauver Drive-Trol Summing/Ramp Board Assembly Part #21513 Figs. 15 & 28.
Anon, Fauver Drive-Trol Basic Board Assembly Part #21515.
Anon, VST Hydrostatic Drives Controls and Accessories, Fauver Co., Inc. 1980.
Anon, Ohio Semitronics, Inc. Catalog for transducers and accompanying diagrams.
Fosse, Ser. No. 974,303 filed 12-29-1978, cited by instant patentee 7-11-1984, p.4.
Anon., Catalog of Ohio Semitronics, Inc. ("Ohio Papers").
Smith, "Automatic Control Engineering", McGraw-Hill, N.Y. (1944) pp. 1-31, 36-41 and 46-57.
Weyrick, "Fundamentals of Applied Instrumentation," McGraw-Hill, N.Y. (1975), pp. 51-54.
Gove et al., Webster's Third New International Dictionary, G. & C. Merriam, Springfield, Mass. (1965), pp. 1400 & 2067, cited as of interest for definitions of verbs sense and measure as meaning "estimate".
Tyson, Industrial Instrumentation, Prentice-Hall, Englewood Cliffs N.J., (1961), p. 221.

*Primary Examiner*—Willard E. Hoag

[57] ABSTRACT

In order to form concrete pipe of uniform density in apparatus where a packer head packs concrete into a mold to form the pipe, the horsepower of the drive motor driving the packer is sensed and used to adjust the rate of concrete supply such as to insure a constant horsepower as the packer is moved from one end of the pipe mold to the other.

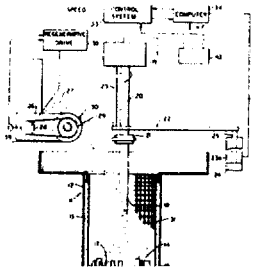

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-3, 16, and 18-20 is confirmed.

Claims 15, 17 and 24 are cancelled.

Claims 4, 13, 14 and 21 are determined to be patentable as amended.

Claims 5-12, 22 and 23, dependent on an amended claim, are determined to be patentable.

New claims 25-27 are added and determined to be patentable.

4. [A control system for use with] *In an* apparatus for making a concrete pipe, said apparatus including a mold; a conveyor for feeding concrete to said mold; a motor for driving said conveyor; a packing head for rotating within said mold to distribute and pack concrete supplied by said conveyor; a drive motor for driving said packing head; and means for controllably raising and [lower] *lowering* said packing head in first and second passes, *the improvement which comprises a control system for said apparatus,* comprising:

(a) a speed control for said conveyor motor having a reference speed input and actual speed input and driving said motor such as to minimize the error therebetween;

(b) a tachometer generator for generating a signal representative of the actual speed;

(c) first means for supplying to said speed controller a first signal representative of a desired speed during the first pass; and (d) second means for supplying a second signal representing a desired speed during the second pass.

13. [An electronic control system for] *In an* apparatus for forming concrete pipe [of uniform density] which includes: a mold having an inner wall[,]; a packing head for packing concrete against the inner wall[,]; a shaft centrally mounted on the packing head[,]; a packing head motor for revolving the packing head through the mold, means for feeding concrete to the mold; a feed motor for driving the concrete feeding means; *and* means for raising said packing head [only at a fixed rate] and lowering said packing head in at least one pass, [comprising] *the improvement which comprises:*

*(a) said means for raising and lowering adapted to raise said packing head only at a fixed rate; and*

*(b) an electronic control system for forming pipe of uniform density,* comprising:

[(a)] *(1)* means for sensing and measuring the components of the actual power being used by the packing head motor said power being a function of torque generated in said packing head;

[(b)] *(2)* means for selecting a desired power;

[(c)] *(3)* means for zeroing out the portion of actual power which represents drive train and other losses at no load to obtain corrected power;

[(d)] *(4)* means for comparing said corrected power to said desired power; and

[(e)] *(5)* means for controlling the speed of said feed motor responsive to said means for comparing, such as to cause said actual power to be only constant and thereby said torque to also be constant, whereby said packing head will evenly pack concrete in said mold.

14. [A control system for] *In an* apparatus for forming concrete pipe [of uniform density] which includes: a mold having an inner wall; a packing head for packing concrete against the inner wall; a shaft centrally mounted on the packing head; a packing head motor for revolving the packing head through the mold; means for feeding concrete to the mold; a feed motor for driving the concrete feeding means; and means for raising said packing head [only at a fixed rate] and lowering said packing head in at least one pass, *the improvement which comprises:*

*(a) said means for raising and lowering adapted to raise said packing head only at a fixed rate; and*

*(b) and electronic control system for forming concrete pipe of uniform density* comprising:

[(a)] *(1)* means for sensing and measuring the components of the actual power being used by the packing head motor said power being a function of torque generated in said packing head;

[(b)] *(2)* means for selecting a desired power;

[(c)] *(3)* an operational amplifier having a summing junction at its input, said amplifier having a variable resistor in its feedback path, for comparing said actual power to said desired power; and

[(d)] *(4)* means for controlling the speed of said feed motor responsive to the output of said operational amplifier, such as to cause said actual power to be only constant and thereby said torque to also be constant, whereby said packing head will evenly pack concrete in said mold.

21. [An electronic control system for] *In an* apparatus for forming concrete pipe [of uniform density] which includes: a mold having an inner wall[,]; a packing head for packing concrete against the inner wall[,]; a shaft centrally mounted on the packing head[,]; a packing head motor for revolving the packing head through the mold, means for feeding concrete to the mold; a feed motor for driving the concrete feeding means; and means for raising said packing head [only at a fixed rate] and for lowering said packing head in at least one pass, *the improvement which comprises:*

*(a) said means for raising and lowering adapted to raise said packing head only at a fixed rate; and*

*(b) an electronic control system for forming concrete pipe of uniform density,* comprising:

[(a)] *(1)* means for sensing and measuring the components of the actual power being used by the packing head motor said power being a function of torque generated in said packing head;

[(b)] *(2)* means for selecting a desired power;

[(c)] (3) means for comparing said sensed power to said desired power; and

[(d)] (4) means for controlling the speed of said feed motor responsive to said means for comparing, such as to cause said actual power to be only constant and thereby said torque to also be constant, whereby said packing head will evenly pack concrete in said mold.

*25. In an apparatus for forming concrete pipe which includes: a mold having an inner wall; a packing head for packing concrete against the inner wall; a shaft centrally mounted on the packing head; a packing head motor for revolving the packing head through the mold; means for feeding concrete to the mold; a feed motor for driving the concrete feeding means; and means for raising said packing head and lowering said packing head in at least one pass, the improvement which comprises:*

*(a) said means for raising and lowering adapted to raise said packing head only at a fixed rate; and*

*(b) a control system for forming concrete pipe of uniform density, comprising:*

*(1) means for sensing and measuring the components of the actual power being used by the packing head motor said power being a function of torque generated in said packing head;*

*(2) means for selecting a desired power;*

*(3) an operational amplifier having a summing junction at its input, said amplifier having first and second variable resistors in its feedback path, for comparing said actual power to said desired power, and further including means to selectively switch said variable resistors into said feedback path respectively, during first and second passes of said packing head; and*

*(4) means for controlling the speed of said feed motor responsive to the output of said operational amplifier such as to cause said actual power to be only constant and thereby said torque to also be constant, whereby said packing head will evenly pack concrete in said mold.*

*26. An apparatus for forming concrete pipe of uniform density comprising:*

*(a) means for forming concrete into the form of said pipe comprising a mold having an inner wall, a packing head for packing concrete against said inner wall, a shaft centrally mounted on said packing head, a packing head motor for revolving said packing head through the mold and means for raising said packing head only at a fixed rate and lowering said packing head in at least one pass;*

*(b) means for feeding concrete to said forming means;*

*(c) a feed motor for driving said concrete feeding means;*

*(d) means for sensing and measuring the components of the actual power being used by said packing head motor said power being a function of torque generated in said packing head;*

*(e) means for selecting a desired power;*

*(f) an operational amplifier having a summing junction at its input, said amplifier having first and second variable resistors in its feedback path, for comparing said actual power to said desired power, and further including means to selectively switch said variable resistors into said feedback path respectively, during first and second passes; and*

*(d) means for controlling the speed of said feed motor responsive to the output of said operational amplifier.*

*27. An electronic control system for an apparatus for forming concrete pipe of uniform density which includes: a mold having an inner wall, a packing head for packing concrete against the inner wall, a shaft centrally mounted on the packing head, a packing head motor for revolving the packing head through the mold; means for feeding concrete to the mold; a feed motor for driving the concrete feeding means; means for raising said packing head only at a fixed rate and lowering the packing head in at least one pass, comprising:*

*(a) means for sensing and measuring the components of the actual power being used by packing head motor said power being a function of torque generated in said packing head;*

*(b) means for selecting a desired power;*

*(c) means for zeroing out the portion of actual power which represents drive train and other losses at no load to obtain corrected power;*

*(d) means for comparing said corrected power to said desired power; and*

*(e) means for controlling the speed of said feed motor responsive to said means for comparing, such as to cause said actual power to be only constant and thereby said torque to also be constant, whereby said packing head will evenly pack concrete in said mold.*

* * * * *